US012455114B2

(12) United States Patent
James et al.

(10) Patent No.: US 12,455,114 B2
(45) Date of Patent: Oct. 28, 2025

(54) SYSTEMS AND METHODS FOR REMOVING NITROGEN DURING LIQUEFACTION OF NATURAL GAS

(71) Applicant: ConocoPhillips Company, Houston, TX (US)

(72) Inventors: Will T. James, Houston, TX (US); Matthew C. Gentry, Houston, TX (US); Wesley R. Qualls, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 127 days.

(21) Appl. No.: 17/092,518

(22) Filed: Nov. 9, 2020

(65) Prior Publication Data

US 2021/0140710 A1 May 13, 2021

Related U.S. Application Data

(60) Provisional application No. 62/932,119, filed on Nov. 7, 2019.

(51) Int. Cl.
*F25J 3/06* (2006.01)

(52) U.S. Cl.
CPC ..... *F25J 3/066* (2013.01); *F25J 3/0615* (2013.01); *F25J 2210/62* (2013.01); *F25J 2215/60* (2013.01); *F25J 2215/62* (2013.01); *F25J 2215/64* (2013.01)

(58) Field of Classification Search
CPC ..... F25J 3/066; F25J 3/0615; F25J 3/0257; F25J 2210/62; F25J 2215/60; F25J 2215/62; F25J 2215/64; F25J 90/32; F25J 90/40; F25J 2200/38; F25J 2205/02; F25J 2270/02
See application file for complete search history.

(56) References Cited

U.S. PATENT DOCUMENTS 4,662,919 A * 5/1987 Davis ..... F25J 3/0233 62/622
5,339,641 A * 8/1994 Mathis ..... F25J 3/0209 62/623
9,003,829 B2 4/2015 Bauer et al.
(Continued)

FOREIGN PATENT DOCUMENTS

EP 1275920 A1 * 1/2003 ..... C07C 7/04
WO WO-2013055305 A1 * 4/2013 ..... F25J 1/0022
(Continued)

OTHER PUBLICATIONS

WO-2019201475-A1 English Translation (Year: 2019).*
(Continued)

*Primary Examiner* — Frantz F Jules
*Assistant Examiner* — Devon Moore
(74) *Attorney, Agent, or Firm* — Polsinelli PC

(57) ABSTRACT

Implementations described and claimed herein provide systems and methods for removing nitrogen during liquefaction of natural gas. In one implementation, a nitrogen rejection unit is used in an LNG facility to remove nitrogen from natural gas during an LNG liquefaction process. The nitrogen rejection unit contains at least two columns and at least one 3-stream condenser, 2-stream condenser or a two 2-stream condenser.

19 Claims, 3 Drawing Sheets

(56) References Cited

U.S. PATENT DOCUMENTS

| | | | | |
|---|---|---|---|---|
| 9,352,990 | B2 | 5/2016 | Regmi et al. | |
| 2010/0115991 | A1 | 5/2010 | Jungerhans | |
| 2014/0238076 | A1 | 8/2014 | Qualls et al. | |
| 2016/0054054 | A1 | 2/2016 | Johnson et al. | |
| 2017/0234612 | A1 | 8/2017 | White et al. | |
| 2018/0231306 | A1 | 8/2018 | Butts | |
| 2021/0080175 | A1 * | 3/2021 | Hernandez | F25J 3/0257 |

FOREIGN PATENT DOCUMENTS

| | | | | |
|---|---|---|---|---|
| WO | WO-2019122654 | A1 * | 6/2019 | F25J 3/0295 |
| WO | WO-2019201475 | A1 * | 10/2019 | F25J 3/04084 |

OTHER PUBLICATIONS

WO-2019122654-A1 English Translation (Year: 2019).*
International Search Report and Written Opinion for International Application No. PCT/US2020/059649 dated Feb. 8, 2021, 9 Pages.
Extended European Search Report for Application No. 20885105.5 dated May 7, 2024 (14 pages).

* cited by examiner

SYSTEMS AND METHODS FOR REMOVING NITROGEN DURING LIQUEFACTION OF NATURAL GAS

CROSS-REFERENCE TO RELATED APPLICATIONS

The present application claims priority to U.S. Provisional Application No. 62/932,119, filed on Nov. 7, 2019, which is incorporated by reference herein in its entirety.

BACKGROUND

I. Technical Field

The present invention relates generally to the liquefaction of natural gas and to systems and methods for removing nitrogen during the liquefaction of natural gas.

II. Related Art

Natural gas is an important resource that is widely used as an energy source or as an industrial feedstock. For example, it is used in the preparation of plastics and carbon tetrachloride. The natural gas is comprised primarily of methane, along with other compounds, such as, ethane, propane, carbon dioxide, nitrogen, hydrogen sulfide, and/or the like.

Natural gas can be transported to markets via a pipeline or other methods, but whatever method is used, cost is a factor. By liquefying the natural gas, it is concentrated and thus, more economically transported. Since natural gas is gaseous under standard atmospheric conditions, it is subjected to certain thermodynamic processes to be liquefied. A benefit of liquefied natural gas (LNG) is that it has a specific volume that is significantly lower than the specific volume of the gaseous form. Thus, when compared to natural gas, it costs less to store and ship LNG.

Some natural gas streams can contain relatively high concentrations of nitrogen, which is an inert gas that lowers the energy value per volume of natural gas. High nitrogen concentrations in gas that is to be liquefied can present one or more of the following drawbacks: (1) the natural gas can be difficult to condense; and, (2) the heating value of the natural gas can be greatly diminished. Accordingly, removing nitrogen from LNG is desirable.

Some LNG facilities seek to lower the concentration of nitrogen in the natural gas stream with units arranged in a two or three column configuration, which often rely solely on an auto-refrigeration system. One problem associated with such processes relates to slow startup and unstable operation due to variable feed compositions. These columns are usually non-refluxed stripped or reboiled absorbers and can produce a nitrogen vent stream. Another drawback is that the nitrogen vent stream can contain relatively high levels of methane. Some units produce nitrogen vent streams containing between about 1% to about 1.5% methane (by mole %).

Large configurations, including five streams, can be difficult to map and exhibit poor performance from less-than-optimal heat integration, which results from attempts to consolidate too may streams to a single exchanger body. Such configurations also suffer from transient fatigue associated with temperature rate of change events and excursions and also exhibit slower start-up times, due to poor heat integration.

It is with these observations in mind, among others, that various aspects of the present disclosure were conceived and developed.

SUMMARY

Implementations described and claimed herein address the foregoing problems by providing systems and methods for removing nitrogen during the liquefaction of natural gas. In one implementation, nitrogen is removed from an at least partially liquefied gas stream by routing the liquefied natural gas through a nitrogen rejection unit. The nitrogen rejection unit includes an upstream nitrogen removal column, a downstream nitrogen removal column, a first condenser, and a second condenser. The first and second condensers are configured to at least partially condense a nitrogen-containing stream via indirect heat exchange. Each condenser is independently a 3-stream condenser, a 2-stream condenser, or a two 2-stream condenser.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
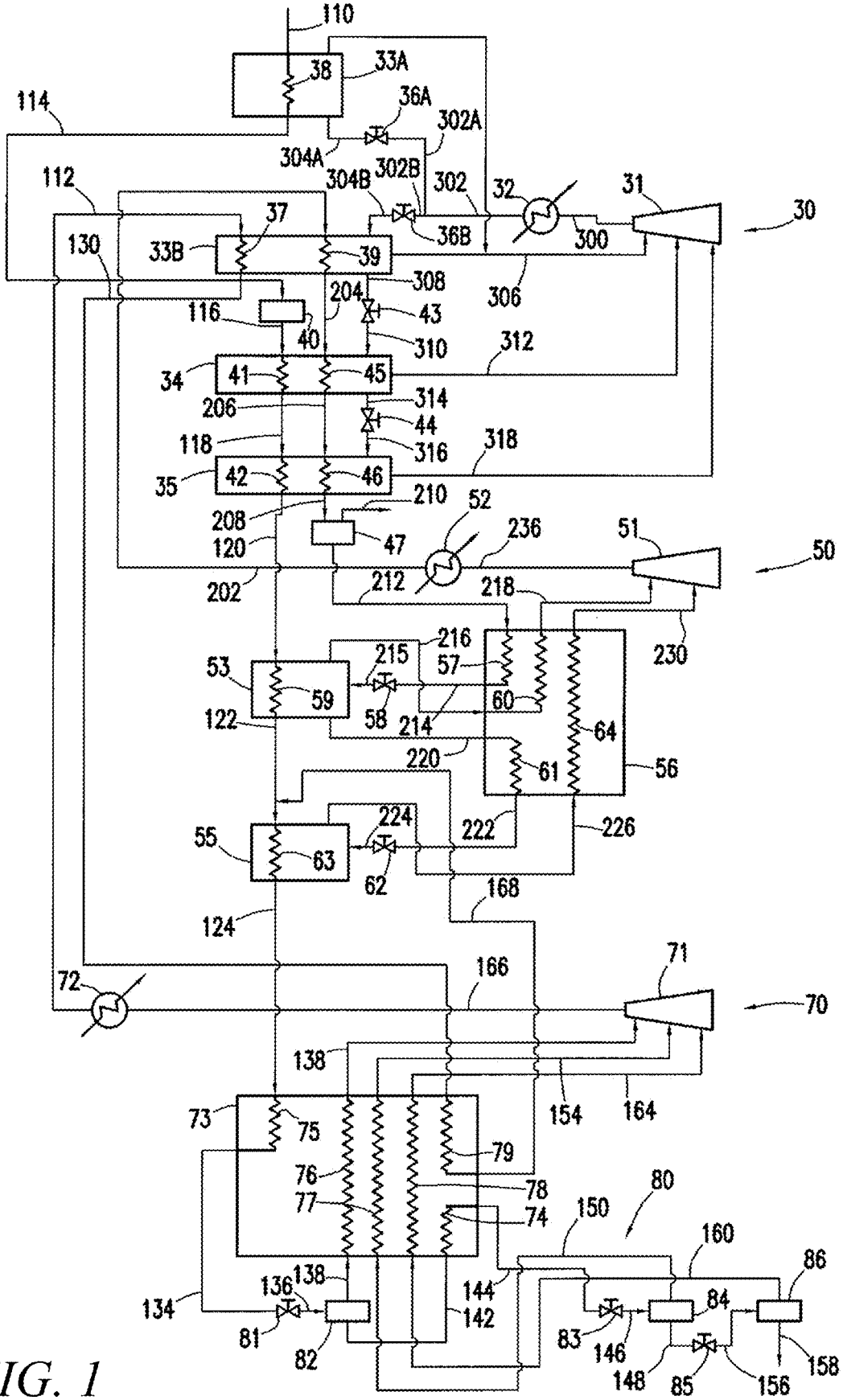
FIG. 1 illustrates an example simplified flow diagram of a cascade refrigeration process with nitrogen removal.

Aspects of the present disclosure relates generally to liquefaction of natural gas, and to systems and methods for removing nitrogen during the liquefaction process. In one aspect, the systems and methods described herein are related to increasing nitrogen separation efficiency during an LNG process, reducing emissions of potentially environmentally-hazardous materials such as methane, improving process efficiency and/or providing stable operation for both a nitrogen rejection unit and main process. The two or more, smaller nitrogen rejection units (NRUs having two or three streams passing through them) of the presently disclosed technology improves the ease of mapping the flow of the components, removes multipass issues, and eliminates transient problems such as temperature rate of change excursions. The resulting streams are easier to integrate into the entire LNG liquefaction process. The use of two or more smaller NRUs also exhibits one or more of the following: shortens startup and cool down time of NRU—allowing facilities to reach full production rates sooner and thus, improving yearly production rates for associated facilities; improves stability of operation (e.g., due to variable feed composition); improves efficiencies of nitrogen removal and overall LNG process; increases nitrogen, helium, and/or argon separation efficiency; reduces hydrocarbon emissions (e.g., methane); reduces overall greenhouse emissions; allows the condensers to be made of stainless steel or other, less expensive materials; increases LNG process stability; complies with higher environmental standards; and/or other advantages.

I. Terminology

The liquefaction process described herein may incorporate one or more of several types of cooling systems and methods including, but not limited to, indirect heat exchange, vaporization, and/or expansion or pressure reduction.

Indirect heat exchange, as used herein, refers to a process involving a cooler stream cooling a substance without actual physical contact between the cooler stream and the substance to be cooled. Specific examples of indirect heat exchange include, but are not limited to, heat exchange undergone in a shell-and-tube heat exchanger, a core-in-shell heat exchanger, and a brazed aluminum plate-fin heat exchanger. The specific physical state of the refrigerant and substance to be cooled can vary depending on demands of the refrigeration system and type of heat exchanger chosen.

Expansion or pressure reduction cooling refers to cooling which occurs when the pressure of a gas, liquid or a two-phase system is decreased by passing through a pressure reduction means. In some implementations, expansion means may be a Joule-Thomson expansion valve. In other implementations, the expansion means may be either a hydraulic or gas expander. Because expanders recover work energy from the expansion process, lower process stream temperatures are possible upon expansion.

In the description, phraseology and terminology are employed for the purpose of description and should not be regarded as limiting. For example, the use of a singular term, such as "a", is not intended as limiting of the number of items. Also, the use of relational terms such as, but not limited to, "down" and "up" or "downstream" and "upstream", are used in the description for clarity in specific reference to the FIGS. and are not intended to limit the scope of the present inventive concept or the appended claims. Further, any one of the features of the present inventive concept may be used separately or in combination with any other feature. For example, references to the term "implementation" means that the feature or features being referred to are included in at least one aspect of the present inventive concept. Separate references to the term "implementation" in this description do not necessarily refer to the same implementation and are also not mutually exclusive unless so stated and/or except as will be readily apparent to those skilled in the art from the description. For example, a feature, structure, process, step, action, or the like described in one implementation may also be included in other implementations, but is not necessarily included. Thus, the present inventive concept may include a variety of combinations and/or integrations of the implementations described herein. Additionally, all aspects of the present inventive concept as described herein are not essential for its practice.

Lastly, the terms "or" and "and/or" as used herein are to be interpreted as inclusive or meaning any one or any combination. Therefore, "A, B or C" or "A, B and/or C" mean any of the following: "A"; "B"; "C"; "A and B"; "A and C"; "B and C"; or "A, B and C." An exception to this definition will occur only when a combination of elements, functions, steps or acts are in some way inherently mutually exclusive.

II. General Architecture and Operations

Some LNG projects introduce pipelines as a source of feed gas in an LNG Optimized Cascade Process (OCP). The Optimized Cascade Process is based on three multi-staged, cascading refrigerants circuits using pure refrigerants, brazed aluminum heat exchangers and insulated cold box modules. Pure refrigerants of propane (or propylene), ethylene, and methane may be utilized.

The Optimized Cascade Process may use a two-stage heavies removal unit (heavies removal unit or HRU) to eliminate C6+ hydrocarbons (i.e. heavy components) from the natural gas prior to condensing the gas to LNG. In the usual case, the gas has already been amine treated and dehydrated prior to heavies removal. Heavies removal is done to prevent freezing from occurring in the liquefaction heat exchangers and to moderate the heating value of the LNG. It also prevents LNG from being outside specification limits due to increased levels of heavy components.

The presently disclosed technology may be implemented in a cascade LNG system employing a cascade-type refrigeration process using one or more predominately pure component refrigerants. The refrigerants utilized in cascade-type refrigeration processes can have successively lower boiling points to facilitate heat removal from the natural gas stream that is being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. In addition to cooling the natural gas stream through indirect heat exchange with one or more refrigerants, cascade and mixed-refrigerant LNG systems can employ one or more expansion cooling stages to simultaneously cool the LNG while reducing its pressure.

In one implementation, the LNG process may employ a cascade-type refrigeration process that uses a plurality of multi-stage cooling cycles, each employing a different refrigerant composition, to sequentially cool the natural gas stream to lower and lower temperatures. For example, a first refrigerant may be used to cool a first refrigeration cycle. A second refrigerant may be used to cool a second refrigeration cycle. A third refrigerant may be used to cool a third refrigeration cycle. Each refrigeration cycle may include a closed cycle or an open cycle. The terms "first", "second", and "third" refer to the relative position of a refrigeration cycle. For example, the first refrigeration cycle is positioned just upstream of the second refrigeration cycle while the second refrigeration cycle is positioned upstream of the third refrigeration cycle and so forth. While at least one reference to a cascade LNG process comprising three different refrigerants in three separate refrigeration cycles is made, this is not intended to be limiting. It is recognized that a cascade LNG process involving any number of refrigerants and/or refrigeration cycles may be compatible with one or more implementations of the presently disclosed technology. Other variations to the cascade LNG process are also contemplated. It will also be appreciated that the presently disclosed technology may be utilized in non-cascade LNG processes. One example of a non-cascade LNG process involves a mixed refrigerant LNG process that employs a combination of two or more refrigerants to cool the natural gas stream in at least one cooling cycle.

To begin a detailed description of an example cascade LNG facility 100 in accordance with the implementations described herein, reference is made to FIG. 1. The LNG facility 100 generally comprises a first refrigeration cycle 30 (e.g., a propane refrigeration cycle), a second refrigeration cycle 50 (e.g., an ethylene refrigeration cycle), and a third refrigeration cycle 70 (e.g., a methane refrigeration cycle) with an expansion section 80. Those skilled in the art will recognize that FIG. 1 is a schematic only and, therefore, various equipment, apparatuses, or systems that would be needed in a commercial plant for successful operation have been omitted for clarity.

Such components might include, for example, compressor controls, flow and level measurements and corresponding controllers, temperature and pressure controls, pumps, motors, filters, additional heat exchangers, valves, and/or the like. Those skilled in the art will recognize such components and how they are integrated into the systems and methods disclosed herein.

In one implementation, the main components of propane refrigeration cycle 30 include a propane compressor 31, a propane cooler/condenser 32, high-stage propane chillers 33A and 33B, an intermediate-stage propane chiller 34, and a low-stage propane chiller 35. The main components of ethylene refrigeration cycle 50 include an ethylene compressor 51, an ethylene cooler 52, a high-stage ethylene chiller 53, a low-stage ethylene chiller/condenser 55, and an ethylene economizer 56. The main components of methane refrigeration cycle 70 include a methane compressor 71, a methane cooler 72, and a methane economizer 73. The main components of expansion section 80 include a high-stage methane expansion valve and/or expander 81, a high-stage methane flash drum 82, an intermediate-stage methane expansion valve and/or expander 83, an intermediate-stage methane flash drum 84, a low-stage methane expansion valve and/or expander 85, and a low-stage methane flash drum 86. While "propane," "ethylene," and "methane" are used to refer to respective first, second, and third refrigerants, it should be understood that these are examples only, and the presently disclosed technology may involve any combination of suitable refrigerants.

Referring to FIG. 1, in one implementation, operation of the LNG facility 100 begins with the propane refrigeration cycle 30. Propane is compressed in a multi-stage (e.g., three-stage) propane compressor 31 driven by, for example, a gas turbine driver (not illustrated). The stages of compression may exist in a single unit or a plurality of separate units mechanically coupled to a single driver. Upon compression, the propane is passed through a conduit 300 to a propane cooler 32 where the propane is cooled and liquefied through indirect heat exchange with an external fluid (e.g., air or water). A portion of the stream from the propane cooler 32 can then be passed through conduits 302 and 302A to a pressure reduction system 36A, for example, an expansion valve, as illustrated in FIG. 1. At the pressure reduction system 36A, the pressure of the liquefied propane is reduced, thereby evaporating or flashing a portion of the liquefied propane. A resulting two-phase stream then flows through a conduit 304A into a high-stage propane chiller 33A, which cools the natural gas stream in indirect heat exchange 38. A high stage propane chiller 33A uses the flashed propane refrigerant to cool the incoming natural gas stream in a conduit 110. Another portion of the stream from the propane cooler 32 is routed through a conduit 302B to another pressure reduction system 36B, illustrated, for example, in FIG. 1 as an expansion valve. At the pressure reduction system 36B, the pressure of the liquefied propane is reduced in a stream 304B.

The cooled natural gas stream from the high-stage propane chiller 33A flows through a conduit 114 to a separation vessel. At the separation vessel, water and in some cases a portion of the propane and/or heavier components are removed. In some cases where removal is not completed in upstream processing, a treatment system 40 may follow the separation vessel. The treatment system 40 removes moisture, mercury and mercury compounds, particulates, and other contaminants to create a treated stream. The stream exits the treatment system 40 through a conduit 116. The stream 116 then enters the intermediate-stage propane chiller 34. At the intermediate-stage propane chiller 34, the stream is cooled in indirect heat exchange 41 via indirect heat exchange with a propane refrigerant stream. The resulting cooled stream output into a conduit 118 is routed to the low-stage propane chiller 35, where the stream can be further cooled through indirect heat exchange means 42. The resultant cooled stream exits the low-stage propane chiller 35 through a conduit 120. Subsequently, the cooled stream in the conduit 120 is routed to the high-stage ethylene chiller 53.

A vaporized propane refrigerant stream exiting the high-stage propane chillers 33A and 33B is returned to a high-stage inlet port of the propane compressor 31 through a conduit 306. An unvaporized propane refrigerant stream exits the high-stage propane chiller 33B via a conduit 308 and is flashed via a pressure reduction system 43, illustrated in FIG. 1 as an expansion valve, for example. The liquid propane refrigerant in the high-stage propane chiller 33A provides refrigeration duty for the natural gas stream. A two-phase refrigerant stream enters the intermediate-stage propane chiller 34 through a conduit 310, thereby providing coolant for the natural gas stream (in conduit 116) and the stream entering the intermediate-stage propane chiller 34 through a conduit 204. The vaporized portion of the propane refrigerant exits the intermediate-stage propane chiller 34 through a conduit 312 and enters an intermediate-stage inlet port of the propane compressor 31. The liquefied portion of the propane refrigerant exits the intermediate-stage propane chiller 34 through a conduit 314 and is passed through a pressure-reduction system 44, for example an expansion valve, whereupon the pressure of the liquefied propane refrigerant is reduced to flash or vaporize a portion of the liquefied propane. The resulting vapor-liquid refrigerant stream is routed to the low-stage propane chiller 35 through a conduit 316. At the low-stage propane chiller 35, the refrigerant stream cools the methane-rich stream and an ethylene refrigerant stream entering the low-stage propane chiller 35 through the conduits 118 and 206, respectively. The vaporized propane refrigerant stream exits the low-stage propane chiller 35 and is routed to a low-stage inlet port of the propane compressor 31 through a conduit 318. The vaporized propane refrigerant stream is compressed and recycled at the propane compressor 31 as previously described.

In one implementation, a stream of ethylene refrigerant in a conduit 202 enters the high-stage propane chiller 33B. At the high-stage propane chiller 33B, the ethylene stream is cooled through indirect heat exchange 39. The resulting cooled ethylene stream is routed in the conduit 204 from the high-stage propane chiller 33B to the intermediate-stage propane chiller 34. Upon entering the intermediate-stage propane chiller 34, the ethylene refrigerant stream may be further cooled through indirect heat exchange 45 in the intermediate-stage propane chiller 34. The resulting cooled ethylene stream exits the intermediate-stage propane chiller 34 and is routed through a conduit 206 to enter the low-stage propane chiller 35. In the low-stage propane chiller 35, the ethylene refrigerant stream is at least partially condensed, or condensed in its entirety, through indirect heat exchange 46. The resulting stream exits the low-stage propane chiller 35 through a conduit 208 and may be routed to a separation vessel 47. At the separation vessel 47, a vapor portion of the stream, if present, is removed through a conduit 210, while a liquid portion of the ethylene refrigerant stream exits the separator 47 through a conduit 212. The liquid portion of the ethylene refrigerant stream exiting the separator 47 may have a representative temperature and pressure of about −24° F. (≈−31° C.) and about 285 psig (≈1,965 kPa and 20 bar). However, other temperatures and pressures are contemplated.

Turning now to the ethylene refrigeration cycle 50 in the LNG facility 100, in one implementation, the liquefied ethylene refrigerant stream in the conduit 212 enters an ethylene economizer 56, and the stream is further cooled by an indirect heat exchange 57 at the ethylene economizer 56. The resulting cooled liquid ethylene stream is output into a conduit 214 and routed through a pressure reduction system 58, such as an expansion valve. The pressure reduction system 58 reduces the pressure of the cooled predominantly liquid ethylene stream to flash or vaporize a portion of the stream. The cooled, two-phase stream in a conduit 215 enters the high-stage ethylene chiller 53. In the high-stage ethylene chiller 53, at least a portion of the ethylene refrigerant stream vaporizes to further cool the stream in the conduit 120 entering an indirect heat exchange 59. The vaporized and remaining liquefied ethylene refrigerant exits the high-stage ethylene chiller 53 through conduits 216 and 220, respectively. The vaporized ethylene refrigerant in the conduit 216 may re-enter the ethylene economizer 56, and the ethylene economizer 56 warms the stream through an indirect heat exchange 60 prior to entering a high-stage inlet port of the ethylene compressor 51 through a conduit 218. Ethylene is compressed in multi-stages (e.g., three-stage) at the ethylene compressor 51 driven by, for example, a gas turbine driver (not illustrated). The stages of compression may exist in a single unit or a plurality of separate units mechanically coupled to a single driver.

The cooled stream in the conduit 120 exiting the low-stage propane chiller 35 is routed to the high-stage ethylene chiller 53, where it is cooled via the indirect heat exchange 59 of the high-stage ethylene chiller 53. The remaining liquefied ethylene refrigerant exiting the high-stage ethylene chiller 53 in a conduit 220 may re-enter the ethylene economizer 56 and undergo further sub-cooling by an indirect heat exchange 61 in the ethylene economizer 56. The resulting sub-cooled refrigerant stream exits the ethylene economizer 56 through a conduit 222 and passes a pressure reduction system 62, such as an expansion valve, whereupon the pressure of the refrigerant stream is reduced to vaporize or flash a portion of the refrigerant stream. The resulting, cooled two-phase stream in a conduit 224 enters the low-stage ethylene chiller/condenser 55.

A portion of the cooled natural gas stream exiting the high-stage ethylene chiller 53 is routed through conduit a 122 to enter an indirect heat exchange 63 of the low-stage ethylene chiller/condenser 55. In the low-stage ethylene chiller/condenser 55, the cooled stream is at least partially condensed and, often, subcooled through indirect heat exchange with the ethylene refrigerant entering the low-stage ethylene chiller/condenser 55 through the conduit 224. The vaporized ethylene refrigerant exits the low-stage ethylene chiller/condenser 55 through a conduit 226, which then enters the ethylene economizer 56. In the ethylene economizer 56, vaporized ethylene refrigerant stream is warmed through an indirect heat exchange 64 prior to being fed into a low-stage inlet port of the ethylene compressor 51 through a conduit 230. As shown in FIG. 1, a stream of compressed ethylene refrigerant exits the ethylene compressor 51 through a conduit 236 and subsequently enters the ethylene cooler 52. At the ethylene cooler 52, the compressed ethylene stream is cooled through indirect heat exchange with an external fluid (e.g., water or air). The resulting cooled ethylene stream may be introduced through the conduit 202 into high-stage propane chiller 33B for additional cooling, as previously described.

The condensed and, often, sub-cooled liquid natural gas stream exiting the low-stage ethylene chiller/condenser 55 in a conduit 124 can also be referred to as a "pressurized LNG-bearing stream." This pressurized LNG-bearing stream exits the low-stage ethylene chiller/condenser 55 through the conduit 124 prior to entering a main methane economizer 73. In the main methane economizer 73, methane-rich stream in the conduit 124 may be further cooled in an indirect heat exchange 75 through indirect heat exchange with one or more methane refrigerant streams (e.g., 76, 77, 78). The cooled, pressurized LNG-bearing stream exits the main methane economizer 73 through a conduit 134 and is routed to the expansion section 80 of the methane refrigeration cycle 70. In the expansion section 80, the pressurized LNG-bearing stream first passes through a high-stage methane expansion valve or expander 81, whereupon the pressure of this stream is reduced to vaporize or flash a portion thereof. The resulting two-phase methane-rich stream in a conduit 136 enters into a high-stage methane flash drum 82. In the high-stage methane flash drum 82, the vapor and liquid portions of the reduced-pressure stream are separated. The vapor portion of the reduced-pressure stream (also called the high-stage flash gas) exits the high-stage methane flash drum 82 through a conduit 138 and enters into the main methane economizer 73. At the main methane economizer 73, at least a portion of the high-stage flash gas is heated through the indirect heat exchange means 76 of the main methane economizer 73. The resulting warmed vapor stream exits the main methane economizer 73 through the conduit 138 and is routed to a high-stage inlet port of the methane compressor 71, as shown in FIG. 1.

The liquid portion of the reduced-pressure stream exits the high-stage methane flash drum 82 through a conduit 142 and re-enters the main methane economizer 73. The main methane economizer 73 cools the liquid stream through indirect heat exchange 74 of the main methane economizer 73. The resulting cooled stream exits the main methane economizer 73 through a conduit 144 and is routed to a second expansion stage, illustrated in FIG. 1 as intermediate-stage expansion valve 83 and/or expander, as an example. The intermediate-stage expansion valve 83 further reduces the pressure of the cooled methane stream, which reduces a temperature of the stream by vaporizing or flashing a portion of the stream. The resulting two-phase methane-rich stream output in a conduit 146 enters an intermediate-stage methane flash drum 84. Liquid and vapor portions of the stream are separated in the intermediate-stage flash drum 84 and output through conduits 148 and 150, respectively. The vapor portion (also called the intermediate-stage flash gas) in the conduit 150 re-enters the methane economizer 73, wherein the vapor portion is heated through an indirect heat exchange 77 of the main methane economizer 73. The resulting warmed stream is routed through a conduit 154 to the intermediate-stage inlet port of methane compressor 71.

The liquid stream exiting the intermediate-stage methane flash drum 84 through the conduit 148 passes through a low-stage expansion valve 85 and/or expander, whereupon the pressure of the liquefied methane-rich stream is further reduced to vaporize or flash a portion of the stream. The resulting cooled two-phase stream is output in a conduit 156 and enters a low-stage methane flash drum 86, which separates the vapor and liquid phases. The liquid stream exiting the low-stage methane flash drum 86 through a conduit 158 comprises the liquefied natural gas (LNG) product at near atmospheric pressure. This LNG product may be routed downstream for subsequent storage, transportation, and/or use.

A vapor stream exiting the low-stage methane flash drum 86 (also called the low-stage methane flash gas) in a conduit 160 is routed to the methane economizer 73. The methane economizer 73 warms the low-stage methane flash gas through an indirect heat exchange 78 of the main methane economizer 73. The resulting stream exits the methane economizer 73 through a conduit 164. The stream is then routed to a low-stage inlet port of the methane compressor 71.

The methane compressor 71 comprises one or more compression stages. In one implementation, the methane compressor 71 comprises three compression stages in a single module. In another implementation, one or more of the compression modules are separate but mechanically coupled to a common driver. Generally, one or more intercoolers (not shown) are provided between subsequent compression stages.

As shown in FIG. 1, a compressed methane refrigerant stream exiting the methane compressor 71 is discharged into a conduit 166. The compressed methane refrigerant is routed to the methane cooler 72, and the stream is cooled through indirect heat exchange with an external fluid (e.g., air or water) in the methane cooler 72. The resulting cooled methane refrigerant stream exits the methane cooler 72 through a conduit 112 and is directed to and further cooled in the propane refrigeration cycle 30. Upon cooling in the propane refrigeration cycle 30 through a heat exchanger 37, the methane refrigerant stream is discharged into s conduit 130 and subsequently routed to the main methane economizer 73, and the stream is further cooled through indirect heat exchange 79. The resulting sub-cooled stream exits the main methane economizer 73 through a conduit 168 and then combined with the stream in the conduit 122 exiting the high-stage ethylene chiller 53 prior to entering the low-stage ethylene chiller/condenser 55, as previously discussed.

In some cases, solid deposition occurs early in the LNG process (i.e. the relative warmer section of the cryogenic process) when processing certain "lean" feed gases, which contain relatively low concentrations of mid-range components (C2-C5) but high concentrations of C6-C11 and C12+. Typically, C6-C11 freezing happens at the later section in the LNG process. However, with cryogenic conditions required for liquefying the natural gases, C12+ often forms solid deposition on the process equipment with even trace concentrations, which is problematic for plant operation and impairs LNG production. Stated, differently LNG plant feedstocks often contain heavy hydrocarbon components which tend to form solids (i.e. "freeze") at the cryogenic temperatures required for a natural gas liquefaction process. Without being sufficiently removed, the heavy components would freeze and deposit on the process equipment in the cold sections of the plant, which could eventually plug the equipment and result a plant shutdown. Thus, in some cases, the feed to the LNG facility 100 contains heavy hydrocarbon material which precipitates and collects in the high-stage ethylene chiller 53. The two-stage heavies removal of the presently disclosed technology solves the freezing issues caused by such "lean" feed gases by removing very heavy freezing components (C12+) prior to the feed gases entering the chilling section in the LNG process, such as the high-stage ethylene chiller 53, therefore preventing the equipment from detriment.

The presently disclosed technology can be implemented in a facility used to cool natural gas to its liquefaction temperature, and thereby produce LNG. The LNG facility generally employs one or more refrigerants to extract heat from the natural gas and reject to the environment. Numerous configurations of LNG systems exist and may be used in conjunction with the nitrogen rejection units and the processes of using the nitrogen rejection units disclosed herein.

As described above, the cascade LNG system employs a cascade-type refrigeration process using one or more predominately pure component refrigerants. The refrigerants utilized in cascade-type refrigeration processes can have successively lower boiling points in order to facilitate heat removal from the natural gas stream being liquefied. Additionally, cascade-type refrigeration processes can include some level of heat integration. For example, a cascade-type refrigeration process can cool one or more refrigerants having a higher volatility through indirect heat exchange with one or more refrigerants having a lower volatility. Examples of such cascades include using propane as the first refrigerant of the cascade, ethylene as the second refrigerant and methane as the third refrigerant. In addition to cooling the natural gas stream through indirect heat exchange with one or more refrigerants, LNG system can employ one or more expansion cooling stages to simultaneously cool the LNG, while reducing its pressure.

A natural gas stream is any stream principally comprised of methane which originates in major portion from a natural gas feed stream, such feed stream for example containing at least 85 mole percent methane, with the balance being undesirable components such as ethane, higher hydrocarbons, nitrogen, carbon dioxide, and a minor amount of other contaminants such as mercury, water, hydrogen sulfide, and mercaptan.

Various pretreatment steps can remove the undesirable components from the natural gas feed stream. Pretreatment steps may be separate steps located either upstream of cooling cycles or located downstream of one of the early stages of cooling, in the initial cycle. Such pretreatment steps are readily known to one skilled in the art. For example, acid gases and to a lesser extent mercaptan can be removed via a chemical reaction process employing an aqueous amine-bearing solution. This treatment step is generally performed upstream of the cooling stages in the initial cycle. A major portion of the water can be removed as a liquid via two-phase gas-liquid separation following gas compression and cooling upstream of the initial cooling cycle and also downstream of the first cooling stage in the initial cooling cycle. Mercury can be removed via mercury sorbent beds. Residual amounts of water and acid gases are routinely removed via the use of properly selected sorbent beds, such as regenerable molecular sieves.

The natural gas feed stream will typically contain such quantities of C2+ components so as to result in the formation of a C2+ rich liquid in one or more of the cooling stages. This liquid is removed via gas-liquid separation means such as, but not limited to, one or more conventional gas-liquid separators. The sequential cooling of the natural gas in each stage can be controlled, so as to remove as much of the C2 and higher molecular weight hydrocarbons as possible. This produces a gas stream comprising predominately methane and a liquid stream containing significant amounts of ethane and heavier components. An effective number of gas/liquid separation means are located at strategic locations downstream of the cooling zones for the removal of liquids streams rich in C2+ components. Exact locations and number of gas/liquid separation means such as, but not limited to, conventional gas/liquid separators, will depend on a number of operating parameters such as, but not limited to, C2+ composition of the natural gas feed stream, desired BTU content of the LNG product, value of the C2+ components for other applications, and other factors routinely considered by those skilled in the art of LNG plant and gas plant operation. The C2+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycled or used as fuel gas. The C2+ hydrocarbon stream or streams or the demethanized C2+ hydrocarbon stream may be used as fuel or may be further processed, by means such as fractionation in one or more fractionation zones, to produce individual streams rich in specific chemical constituents (e.g., C2, C3, C4, and C5+).

The pretreated natural gas feed stream is generally delivered to the liquefaction process at an elevated pressure or is compressed to an elevated pressure generally greater than 500 psia, between about 500 psia to about 3000 psia, between about 500 psia to about 1000 psia, between about 600 psia to about 800 psia. Temperature of the pretreated natural gas feed stream is typically near ambient to slightly below ambient. A representative temperature range is from about 60° F. (16° C.) to about 77° F. (25° C.).

Pressurized LNG-bearing stream (or streams) can then be subsequently cooled, which results in sequential expansion of the pressurized LNG-bearing stream to near atmospheric pressure. Flash gasses used as a refrigerant in the third refrigeration cycle may comprise in major portion of methane, at least 75 mole percent methane, at least 90 mole percent methane, or may consist essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. In at least one implementation, additional cooling of the pressurized LNG-bearing stream prior to flashing is made possible by first flashing a portion of this stream via one or more hydraulic expanders and then via indirect heat exchange means that employ said flash gas stream to cool the remaining portion of the pressurized LNG-bearing stream. The warmed flash gas stream is then recycled via return to an appropriate location, based on temperature and pressure considerations, in the open methane cycle and may be recompressed.

In one implementation, liquefaction of the natural gas involves cooling a natural gas stream in a first refrigeration cycle to produce a cooled natural gas stream and cooling the cooled natural gas stream in a first chiller of a second refrigeration cycle. The cooled natural gas stream exits the first chiller at a first pressure. The cooled natural gas stream is cooled in a first core of a second chiller of the second refrigeration cycle. A refrigerant of a refrigerant recycle stream is cooled separate from the cooled natural gas stream in a second core of the second chiller of the second refrigeration cycle. The refrigerant recycle stream enters the second chiller at a second pressure that is lower than the first pressure of the cooled natural gas stream. Nitrogen is removed from the liquefied gas stream by passing the liquefied natural gas through a nitrogen rejection unit (NRU). In one implementation, the NRU includes an upstream nitrogen removal column, a downstream nitrogen removal column, a first condenser, and a second condenser. The first second condensers are configured to at least partially condense a nitrogen-containing stream via indirect heat exchange. Each condenser is independently a 3-stream condenser, a 2-stream condenser, or a two 2-stream condenser.

In another implementation, a first refrigeration cycle includes a plurality of chillers configured to cool a natural gas feed stream. A second refrigeration cycle includes a first chiller and a second chiller each configured to cool the natural gas feed stream. A refrigerant of a refrigerant recycle stream is included, and a first core of the second chiller is configured to route the natural gas feed stream through the second chiller. A second core of the second chiller is configured to route the refrigerant recycle stream through the second chiller. The natural gas feed stream and the refrigerant recycle stream are separately cooled and condensed in the second chiller. Nitrogen is removed from the liquefied gas stream by passing the liquefied natural gas through the NRU. The NRU includes an upstream nitrogen removal column, a downstream nitrogen removal column, a first condenser, and a second condenser. The first and second condensers are configured to at least partially condense a nitrogen-containing stream via indirect heat exchange, and each condenser is independently a 3-stream condenser, a 2-stream condenser or a two 2-stream condenser.

The liquefied gas streams may be two phase, such that they may contain gas and liquid. In one implementation, liquefaction of the natural gas includes cooling the natural gas stream in a first refrigeration cycle to produce a cooled natural gas stream, and cooling the cooled natural gas stream in a first chiller of a second refrigeration cycle. The cooled natural gas stream exits the first chiller at a first pressure. The cooled natural gas stream is cooled in a first core of a second chiller of the second refrigeration cycle, and a refrigerant of a refrigerant recycle stream is cooled separate from the cooled natural gas stream in a second core of the second chiller of the second refrigeration cycle. The refrigerant recycle stream enters the second chiller at a second pressure that is lower than the first pressure of the cooled natural gas stream. The cooled natural gas stream is routed from the second refrigerant cycle to a heat exchanger for cooling therein. The pressure of the cooled natural gas stream is reduced in a first expansion component disposed downstream of the heat exchanger, and the cooled natural gas stream is routed to a first flash drum configured to separate the cooled natural gas stream into a natural gas vapor portion and a natural gas liquid portion. The natural gas vapor portion is routed to the heat exchanger for heating therein, and the natural gas vapor portion is routed from the heat exchanger to an inlet port of a compressor. The refrigerant recycle stream is routed from the second chiller of the second refrigeration cycle to a methane recycle flash drum configured to separate the refrigerant recycle stream into a refrigerant vapor portion and a refrigerant liquid portion, and the refrigerant liquid portion is routed to the heat exchanger for cooling therein. The pressure of the refrigerant liquid portion is reduced in a second expansion component disposed downstream of the heat exchanger. The refrigerant liquid portion is routed to a second flash drum configured to separate the refrigerant liquid portion into a refrigeration recycle vapor portion and a refrigeration recycle liquid portion. The refrigerant recycle vapor portion can be routed to a nitrogen rejection unit, along with or independent of the natural gas vapor and/or the natural gas liquid.

This liquefaction process can further include compressing the refrigerant in the compressor; cooling the refrigerant downstream of the compressor; cooling the refrigerant in the heat exchanger; and routing the refrigerant out of the heat exchanger to produce the refrigerant recycle stream that is configured to be cooled downstream of the heat exchanger in the second core of the second chiller of the second refrigeration cycle.

The liquefaction processes described herein may incorporate one of several types of cooling means including, but not limited to, (a) indirect heat exchange, (b) vaporization, and (c) expansion or pressure reduction. Indirect heat exchange, as used herein, refers to a process in which the refrigerant cools the substance to be cooled without actual physical contact between the refrigerating agent and the substance to be cooled. Specific examples of indirect heat exchange means include heat exchange undergone in a shell-and-tube heat exchanger, a core-in-shell heat exchanger, a brazed aluminum plate-fin heat exchanger, and a printed circuit heat exchanger. The specific physical state of the refrigerant and substance to be cooled can vary depending on demands of the refrigeration system and type of heat exchanger chosen. For example, a shell-and-tube heat exchanger may be utilized where the refrigerant is in a liquid state and the substance to be cooled is in a liquid or gaseous state or when one of the substances undergoes a phase change and process conditions do not favor the use of a core-in-shell heat exchange. In some implementations, aluminum and aluminum alloys may be used in constructing the core.

Each condenser is independently selected from the group consisting of: core-in-shell exchanger, brazed aluminum heat exchanger, shell and tube exchanger, kettle exchanger, printed circuit heat exchanger, and any combination thereof. A plate-fin heat exchanger may be utilized where the refrigerant is in a gaseous state and the substance to be cooled is in a liquid or gaseous state. The core-in-shell heat exchanger may be utilized where the substance to be cooled is liquid or gas and the refrigerant undergoes a phase change from a liquid state to a gaseous state during the heat exchange. Another heat exchanger that may be used is the printed circuit heat exchanger, which can be used to cool liquids and gases. This type of heat exchanger is made from metal, commonly stainless steel, and it contains micro-channels, through which the fluids flow. They are made from a plurality of plates, which are stacked and bonded together to form strong, compact, all-metal heat exchange core. Printed circuit heat exchangers have a core with no joints, welds or points of failure. The micro-channels can be made by chemical etching, hydraulic milling, or cutting, and they may have various shapes, such as, for example, wavy or curved. They are compact, robust, corrosion resistant, and efficient. They may be coupled with a strainer, which can remove particles or otherwise prevent undesired components from entering the heat exchanger. Preferred condensers are printed circuit heat exchangers. Smaller heat exchangers, having three of fewer streams passing through, are less expensive to manufacture and allow for the use of stainless steel materials of construction throughout the NRU, which improves cooldown and start-up times of the NRU. In contrast, larger heat exchangers (having at least five streams passing through) are commonly made of aluminum, which is less durable and more expensive than stainless steel.

One, two, three, four, five, six or more condensers may be used in the NRU. In some implementations, the NRU further comprises a third condenser, in others, a third and a fourth. In one implementation, at least one condenser is a printed circuit heat exchanger. In another implementation, at least two condensers are printed circuit heat exchangers. Each heat exchanger used in the NRUs and processes disclosed herein contains three or fewer streams. In one implementation, the first condenser is a 3-stream heat exchanger. Various configurations of heat exchangers that can be used include the following: the first and second condensers are 3-stream condensers; or the first condenser is a 3-stream condenser and the second and third condensers are two-stream condensers; or the first condenser is a 3-stream condenser and the second condenser is a two 2-stream condenser. In one implementation, one heat exchanger is a 3-stream heat exchanger, and the other two heat exchangers are two-stream heat exchangers. Each condenser is independently a partial condenser or a full condenser. In one implementation, the third condenser is a 2-stream condenser.

Vaporization cooling refers to the cooling of a substance by evaporation or vaporization of a portion of the substance at a constant pressure. During vaporization, portion of the substance which evaporates absorbs heat from portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In some implementations, expansion means may be a Joule-Thomson expansion valve. In other implementations, the expansion means may be either a hydraulic or gas expander. Because expanders recover work energy from the expansion process, lower process stream temperatures are possible upon expansion.

An integrated NRU integrates external heat and refrigerant sources contained within an LNG or gas plant to enhance thermal and separation efficiency of the plant, as well as overall operating flexibility and stability. This design also allows independent adjustment of refrigerant and heat sources to allow adjustments for wider variations in feed composition and to promote greater turn down capacity.

The NRU may be housed in a separate insulated enclosure to form a nitrogen cold box or integrated within a methane cold box. The NRU is configured to at least partially condense a nitrogen-containing stream via indirect heat exchange with a recycled refrigerant stream. The recycled refrigerant stream comprises at least one of: methane, ethylene, propane, and any combination thereof. The recycled refrigerant stream typically comes from the liquefaction process. The recycled refrigerant stream may comprise methane.

In one implementation, the NRU includes an upstream nitrogen removal column and a downstream nitrogen removal column. The NRU further includes a first condenser and a second condenser. The first and second condensers are configured to at least partially condense a nitrogen-containing stream via indirect heat exchange. Each condenser is independently a 3-stream condenser, a 2-stream condenser or a two 2-stream condenser. The NRU may further include an intermediate nitrogen removal column, with the intermediate nitrogen removal column between the upstream nitrogen removal column and the downstream nitrogen removal column. One condenser provides condensing duty to the upstream nitrogen removal column and one condenser provides condensing duty to the intermediate nitrogen removal column. Condensing duty is understood to mean cooling, while heating duty is understood to mean heating.

The NRU can further comprise a third condenser. The condensers useful in the disclosed NRUs and processes include core-in-shell exchanger, brazed aluminum heat exchanger, shell and tube exchanger, kettle exchanger, printed circuit heat exchanger, and any combination thereof. In one implementation, the third condenser is a printed circuit heat exchanger.

The number of streams passing through the condensers disclosed herein is typically 3 or fewer. By having fewer streams pass through an individual condenser, better heat transfer occurs, and improved start-up and shutdown times result. This approach is atypical, as many NRUs utilize large condensers that have five or more streams passing through them. When at least two condensers are used, different numbers of streams passing through the condenser may be selected. And the use of condensers having three or fewer streams passing through them allows the condenser to be made of a more durable and cost effective material, such as stainless steel. In contrast, the larger condensers are typically made of aluminum, which is less durable, while also being expensive.

As described herein, in one implementation, nitrogen is removed from the liquefied gas stream by routing the liquefied natural gas through a nitrogen rejection unit. The liquefied natural gas stream is routed to an upstream nitrogen removal column, where a first top stream and a first bottom stream form. A portion of the first top stream is routed to the first condenser, where the first top stream is cooled. The cooled first top stream is routed to the second condenser where it is further cooled and routed towards the top of a downstream nitrogen removal column.

Another portion of the top stream is routed to the downstream nitrogen removal column. This portion is introduced towards the bottom of the downstream nitrogen removal column. A second top stream and a second bottom stream are formed in the downstream nitrogen removal column. The second top stream is predominantly nitrogen. At least a portion of the second top stream is removed from the nitrogen rejection unit, and at least a portion of the second bottom stream is collected from the downstream nitrogen removal column. The second bottom stream is predominantly methane.

In one implementation, nitrogen is removed from the liquefied gas stream by routing the natural gas stream to the upstream nitrogen removal column, and a first top stream and a first bottom stream form. A portion of the first top stream is routed to the first condenser, where it is at least partially condensed. The first top stream is routed from the first condenser to the intermediate nitrogen removal column, where a second top stream and a second bottom stream are formed. At least a portion of the second top stream is routed to the second condenser, where it is condensed, before it is routed to the downstream nitrogen removal column. The second bottom stream is routed to the second condenser, before it is routed to the downstream nitrogen removal column. In the downstream nitrogen removal column, a third top stream comprising >90 wt % nitrogen and a third bottom stream comprising >90 wt % methane are formed. At least a portion of the third top stream is routed to the second condenser and then to the first condenser, and the third bottom stream is routed to the first condenser. In one implementation, the condensed second top stream is routed to a third condenser, before it is routed to the downstream nitrogen removal column. The third condenser can be a 3-stream condenser, a 2-stream condenser, or a two-2-stream condenser.

The nitrogen rejection unit may further comprise one or more reboilers, with each reboiler providing heating duty to one or more of the nitrogen removal columns. The bottom stream from the upstream nitrogen removal column can be routed out of the NRU. It can be recycled to the liquefaction process, sent to a different process, separated into at least some of its components, and/or discarded. When the nitrogen is vented to the atmosphere, it preferably contains less than 1 mol % methane. The heating duty to one or more of the nitrogen removal columns may be provided by stripping gas or heating gas.

The natural gas gas-stream from a main liquefaction process is a natural gas stream from a methane cold box of a main liquefaction process. The main liquefaction process includes one or more refrigeration cycles external to the nitrogen rejection unit. In one implementation, the natural gas stream from the methane cold box is a predominantly methane gas stream.

The bottom stream from the intermediate (if two nitrogen removal columns are used) or the downstream nitrogen removal column (if three nitrogen removal columns are used), is enriched in methane, relative to the natural gas that entered the NRU, and is routed to the main liquefaction process.

Figure 2:
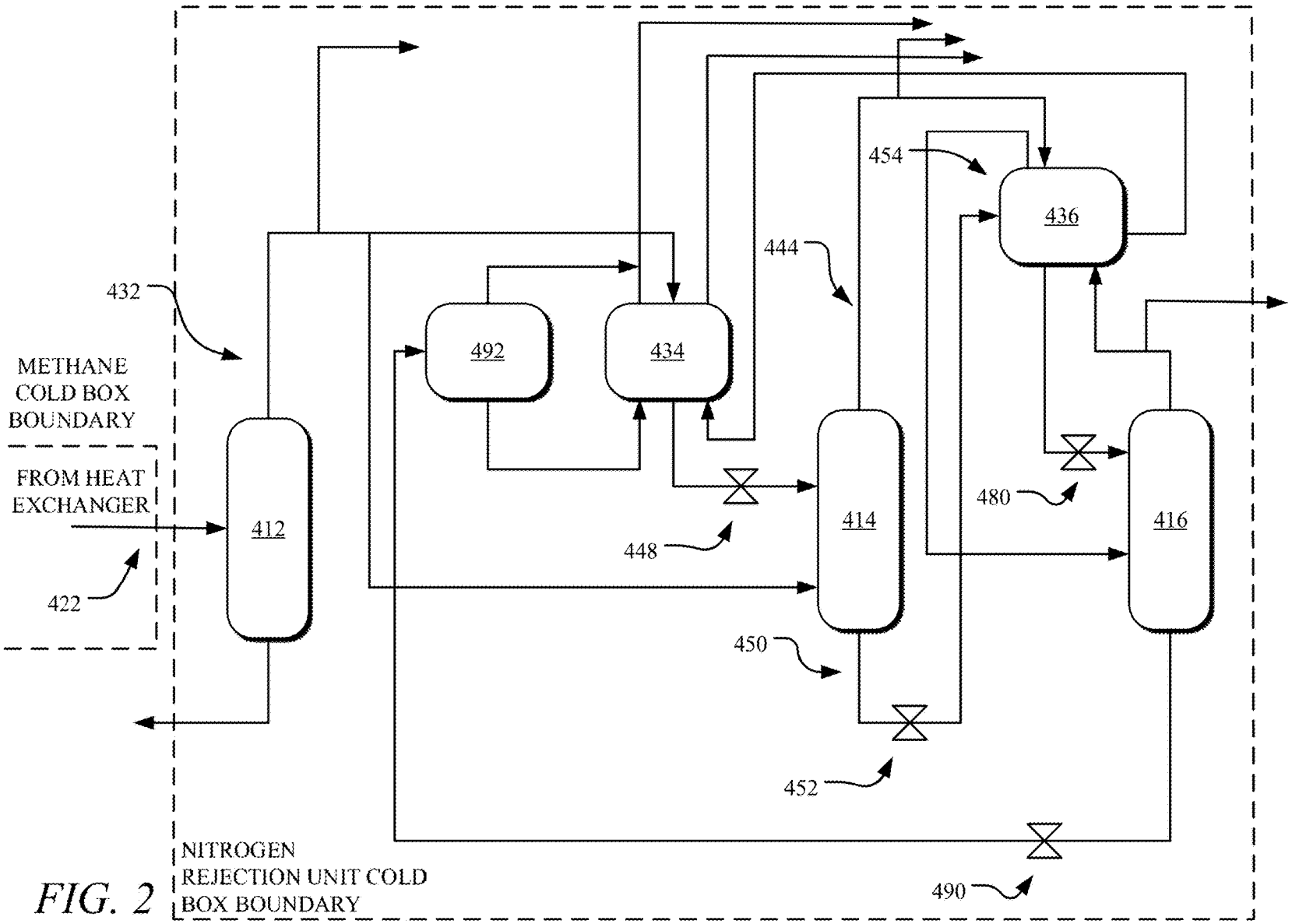
FIG. 2 is a simplified flow diagram of an example integrated nitrogen rejection unit.
Figure 3:
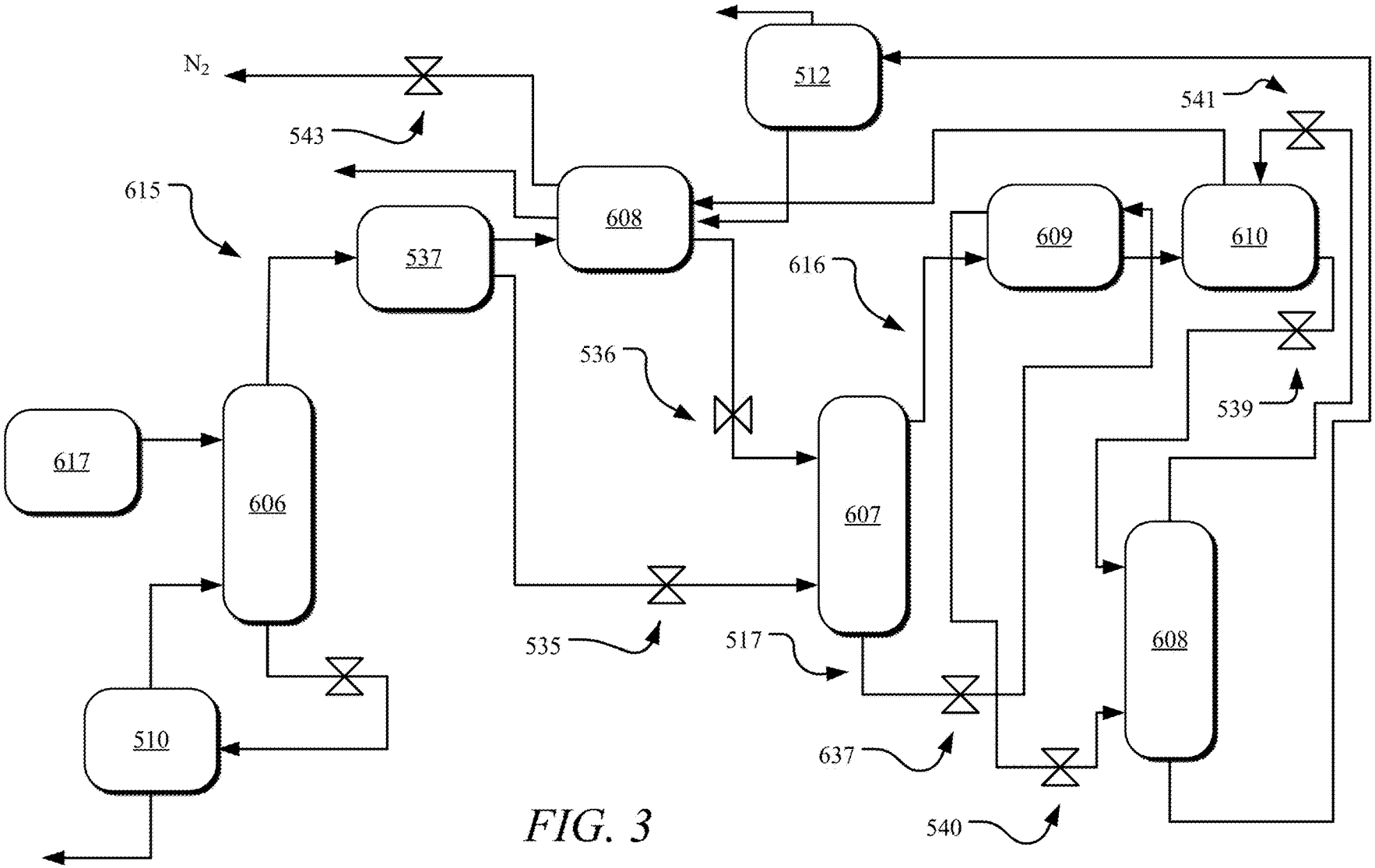
FIG. 3 is a simplified flow diagram of another example integrated nitrogen rejection unit.

As can be understood from FIGS. 1-3, the LNG facility 100 utilizes the NRUs described herein. In one implementation, the LNG facility 100 includes one or more refrigeration cycles for successively cooling a fluid stream. Each refrigeration cycle includes a refrigerant, a compressor, and a chiller. An NRU may include an upstream nitrogen removal column, a downstream nitrogen removal column a first condenser, and a second condenser. The first and second condensers are configured to at least partially condense a nitrogen-containing stream via indirect heat exchange, and each condenser is independently a 3-stream condenser, a 2-stream condenser, or a two 2-stream condenser. The LNG facility 100 can further include an intermediate nitrogen removal column that is between the upstream nitrogen removal column and the downstream nitrogen removal column. One condenser can provide condensing duty to the upstream nitrogen removal column and one condenser can provide condensing duty to the intermediate nitrogen. In one implementation, the first condenser provides condensing duty to the upstream nitrogen removal column and the second condenser provides condensing duty to the intermediate nitrogen removal column. Further, the one or more refrigeration cycles are open or closed refrigeration cycles.

As shown in FIG. 2, cold feed natural gas stream is fed into a heat exchanger within a methane cold box, where the stream is either fully or partially condensed. In some implementations, exchanger types such as, but not limited to, kettle exchanger with a conventional tube bundle, shell and tube exchangers, brazed aluminum heat exchangers and/or printed circuit heat exchangers may be used. The condensed or partially condensed stream exits the heat exchanger via conduit 422 and enters the upstream nitrogen removal column 412. The upstream nitrogen column 412 can perform pre-separation of the feed stream to concentrate nitrogen in the upstream nitrogen column 412 to approximately 50% or greater, while minimizing nitrogen returning to the main liquefaction process. The upstream nitrogen column 412 may contain random packing, structured packing, trays or combinations thereof. The feed condenser duty for the heat exchanger can be provided by a refrigerant stream taken from main liquefaction process as an external source to the NRU. In the upstream nitrogen removal column 412, a first top stream and a first bottom stream are formed. The first bottom stream, which contains the bottoms or heavies, exits the upstream nitrogen column 412 and then exits the NRU.

A portion of the upstream nitrogen column first top stream 432 is routed through conduit and condensed or partially condensed in one pass of a 3-stream condenser 434 before expanding, illustrated here as expansion valve 448, into the intermediate nitrogen removal column top feed location. The intermediate nitrogen column 414 may contain random packing, structured packing, trays or combinations thereof. The remaining non-condensed portion of the upstream nitrogen removal column overhead vapor in stream 432 is routed to a bottom feed location of intermediate nitrogen column 414 to provide direct heating to the second nitrogen column 414 via stripping or heating gas. A portion of the upstream nitrogen removal column overhead vapor in stream 432 may also be removed from the NRU.

The second top stream 444 of intermediate nitrogen removal column 414 is condensed or partially condensed in condenser 436, before expanding through expansion valve 480, and entering towards the top feed of the downstream nitrogen removal column 416. In FIG. 2, condenser 436 is a two 2-stream condenser.

All or a portion of the intermediate nitrogen column bottom stream 450 is expanded through an expansion valve 452 to a lower pressure and heated in condenser 436, before being routed to the bottom feed location of the downstream nitrogen removal column 416, to provide direct heating to the downstream nitrogen removal column 416 via stripping or heating gas. A small separator (not shown) may be provided to assist in the liquid and vapor distribution through pass 454 of the condenser 436. A portion of the intermediate nitrogen removal column overhead vapor in stream 444 may also be removed from the NRU.

A portion of the top stream of the downstream nitrogen removal column 416 is enriched in methane and enters condenser 436 where it is warmed. It then enters condenser 434, where it is further warmed, before exiting the NRU. Another portion of the third top stream of the downstream nitrogen removal column 416 does not enter condenser 436 and instead, leaves the NRU.

The third bottom stream of the downstream nitrogen removal column 416 expands through expansion valve 490, before entering expansion drum 492, where the gases exit the NRU without entering the condenser 434, while the liquid leaving expansion drum 492 passes through condenser 434, where it is warmed, before exiting the NRU.

As shown in FIG. 3, cold feed natural gas stream is fed into a heat exchanger 617 where the stream is either fully or partially condensed. In some implementations, exchanger types such as, but not limited to, kettle exchanger with a conventional tube bundle, shell and tube exchangers, brazed aluminum heat exchangers and/or printed circuit heat exchangers may be used. The condensed or partially condensed stream exits the heat exchanger and enters the upstream nitrogen removal column. The upstream nitrogen column 606 can perform pre-separation of the feed stream to concentrate nitrogen in the upstream nitrogen column 606 to approximately 50% or greater, while minimizing nitrogen returning to the main liquefaction process. In some implementations, the upstream nitrogen column 606 may contain random packing, structured packing, trays or combinations thereof. As shown in FIG. 3, the first bottom stream of the upstream nitrogen column 606 is temperature adjusted by going through one or more valves, before it enters a sump 510, where the gas is separated from the liquid. The liquid exits the NRU, while the gas is returned to the bottom of the upstream nitrogen removal column, where it provides direct heating to the upstream nitrogen column 606 via stripping or heating gas. The feed condenser duty for the heat exchanger can be provided by a refrigerant stream taken from main liquefaction process as an external source to the nitrogen rejection unit.

A portion of the upstream nitrogen column first top stream 615 is routed through conduit to separator 537, where stream 615 is split into two portions, where one portion is condensed or partially condensed in one pass of a 3-stream condenser 608 before expanding, illustrated here as expansion valve 536, into the intermediate nitrogen removal column 607 top feed location. The intermediate nitrogen removal column 607 may contain random packing, structured packing, trays or combinations thereof. The other portion of stream 615 passes through valve 535, where it is temperature adjusted, before it is routed to a bottom feed location of intermediate nitrogen removal column 607 to provide direct heating to the second nitrogen removal column 607 via stripping or heating gas.

The second top stream 616 of intermediate nitrogen removal column 607 is condensed or partially condensed in condenser 609, and further cooled in condenser 610, before expanding through expansion valve 539, and entering towards the top of the downstream nitrogen removal column 608. In FIG. 3, condenser 608 is a 3-stream condenser, while condensers 609 and 610 are 2-stream condensers.

All or a portion of the intermediate nitrogen removal column bottom stream 517 is expanded through an expansion valve 637 to a lower pressure and heated in condenser 609, before routing through expansion valve 540 and entering the bottom feed location of the downstream nitrogen removal column 608, to provide direct heating to the downstream nitrogen removal column 608 via stripping or heating gas.

A portion of the top stream of the downstream nitrogen removal column 608 passes through expansion valve 541, where it is cooled, before it enters condenser 610 and is warmed. It then enters condenser 608, where it is further warmed, before routing through expansion valve 543 and exiting the NRU.

The third bottom stream of the downstream nitrogen removal column 608 expands through one or more expansion valves, before entering expansion drum 512, where the gases exit the NRU without entering the condenser 608. The liquid leaving expansion drum 512 enters the condenser 608, where it is warmed, before exiting the NRU. While not shown in FIGS. 2-3, additional valves, drums, reboilers, condensers and columns may be used. Examples of reboilers include external thermosyphon or kettle exchanger of various types and configurations. Each reboiler proves heating duty to the upstream nitrogen removal column, the intermediate nitrogen removal column (if present), the downstream nitrogen removal column, or combinations of two or more thereof. Each nitrogen removal column optionally comprises a trap out tray, a chimney tray, or both.

It will be appreciated that the various example LNG production systems of FIGS. 1-3 are exemplary only and other systems or modifications to these systems may be used to remove nitrogen in accordance with the presently disclosed technology.

It is understood that the specific order or hierarchy of steps in the methods disclosed are instances of example approaches and can be rearranged while remaining within the disclosed subject matter. The accompanying method claims thus present elements of the various steps in a sample order, and are not necessarily meant to be limited to the specific order or hierarchy presented.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A method for removing nitrogen from a natural gas stream in a liquefied natural gas facility, the method comprising:

liquefying the natural gas stream at least partially in the liquefied natural gas facility to form a liquefied natural gas stream;

routing the liquefied natural gas stream through a nitrogen rejection unit, the nitrogen rejection unit including an upstream nitrogen removal column, a downstream nitrogen removal column, an intermediate nitrogen removal column, a first condenser, and a second condenser;

condensing a nitrogen-containing stream of the liquefied natural gas stream at least partially via indirect heat exchange using the first condenser and the second condenser, each of the first condenser and the second condenser being independently a 3-stream condenser or a 2-stream condenser, the nitrogen rejection unit removing nitrogen from the liquefied natural gas stream;

routing the liquefied natural gas stream to the upstream nitrogen removal column, where a first top stream and a first bottom stream form;

routing a first portion of the first top stream to the first condenser;

removing a second portion of the first top stream from the nitrogen rejection unit;

routing a third portion of the first top stream to the intermediate nitrogen removal column;

removing the first bottom stream from the nitrogen rejection unit, the first bottom stream removed from the nitrogen rejection unit containing heavies;

routing the first portion of the first top stream from the first condenser to the intermediate nitrogen removal column, where a second top stream and a second bottom stream are formed;

routing at least a portion of the second top stream to the second condenser before routing to the downstream nitrogen removal column;

forming a third top stream and a third bottom stream in the downstream nitrogen removal column, wherein the third top stream comprises predominantly nitrogen;

routing the third bottom stream to an expansion drum;

forming a liquid stream and a gas stream using the expansion drum;

routing the liquid stream to the first condenser, the first condenser warming the liquid stream to form a warmed liquid stream before exiting the nitrogen rejection unit; and combining the gas stream with the warmed liquid stream.

2. The method of claim 1, wherein each of the first condenser and the second condenser is independently selected from the group consisting of: core-in-shell exchanger, brazed aluminum heat exchanger, shell and tube exchanger, kettle exchanger, printed circuit heat exchanger, and any combination thereof.

3. The method of claim 1, wherein the first portion of the first top stream is cooled by the first condenser;

wherein the at least a portion of the second top stream is cooled by the second condenser; and wherein the method further comprises:

routing the second top stream towards a top of the downstream nitrogen removal column;

routing the second bottom stream to the downstream nitrogen removal column, wherein the second bottom stream is introduced towards a bottom of the downstream nitrogen removal column;

removing at least a portion of the third top stream from the nitrogen rejection unit; and collecting at least a portion of the third bottom stream from the downstream nitrogen removal column, the third bottom stream comprising predominantly methane.

4. The method of claim 1, wherein the first portion of the first top stream is at least partially condensed by the first condenser;

wherein the at least a portion of the second top stream is being condensed before routing to the downstream nitrogen removal column; and wherein the method further comprises:

routing the second bottom stream to the second condenser before routing to the downstream nitrogen removal column;

routing at least a portion of the third top stream to the second condenser and then to the first condenser; and routing the third bottom stream to the first condenser, the third bottom stream comprising methane.

5. The method of claim 1, wherein the nitrogen rejection unit further comprises one or more reboilers, the one or more reboilers providing heating duty to one or more of the upstream, intermediate, and downstream nitrogen removal columns.

6. The method of claim 1, wherein one or more of the upstream, intermediate, and downstream nitrogen removal columns provide a heating duty via a stripping gas or heating gas.

7. The method of claim 1, wherein at least one of the first condenser or the second condenser is a printed circuit heat exchanger.

8. The method of claim 1, wherein the first condenser and second condenser are 3-stream condensers; or the first condenser is the 3-stream condenser and the second condenser and a third condenser are the 2-stream condensers.

9. The method of claim 1, wherein the natural gas stream from a main liquefaction process is a natural gas stream from a methane cold box of a main liquefaction process, the main liquefaction process including one or more refrigeration cycles external to the nitrogen rejection unit.

10. The method of claim 1, wherein one or more of the upstream nitrogen removal column and the downstream nitrogen removal column includes a trap out tray, a chimney tray, or both.

11. The method of claim 4, wherein the condensed second top stream is routed to a third condenser before it is routed to the downstream nitrogen removal column.

12. The method of claim 9, wherein a bottom stream from the downstream nitrogen removal column is routed to the main liquefaction process.

13. A liquefied natural gas system comprising:

one or more refrigeration cycles successively cooling a fluid stream, each of the one or more refrigeration cycles including a refrigerant, a compressor, and a chiller;

an upstream nitrogen removal column of a nitrogen rejection unit wherein the upstream nitrogen removal column is operable to form a first top stream and a first bottom stream from a nitrogen-containing stream, the first bottom stream removed from the nitrogen rejection unit, and the first bottom stream removed from the nitrogen rejection unit containing heavies;

a downstream nitrogen removal column of the nitrogen rejection unit;

an intermediate nitrogen removal column of the nitrogen rejection unit disposed between the upstream nitrogen removal column and the downstream nitrogen removal column;

a first condenser of the nitrogen rejection unit, wherein a first portion of the first top stream is routed to the first condenser before being routed to the intermediate nitrogen removal column, a second portion of the first top stream is removed from the nitrogen rejection unit, and a third portion of the first top stream is routed to the intermediate nitrogen removal column, and wherein the intermediate nitrogen removal column is operable to form a second top stream and a second bottom stream;

a second condenser of the nitrogen rejection unit, wherein at least a portion of the second top stream is routed to the second condenser before routing to the downstream nitrogen removal column, and wherein the first condenser and second condenser at least partially condense the nitrogen-containing stream via indirect heat exchange, and each of the first condenser and the second condenser are independently a 3-stream condenser, or a 2-stream condenser; and an expansion drum of the nitrogen rejection unit configured to receive a third bottom stream formed in the downstream nitrogen removal column, the expansion drum configured to form a liquid stream and a gas stream, the liquid stream routed to the first condenser, the first condenser warming the liquid stream before exiting the nitrogen rejection unit to form a warmed liquid stream, the gas stream combined with the warmed liquid stream.

14. The liquefied natural gas system of claim 13, wherein the indirect heat exchange is by contact with a recycled refrigerant stream, and wherein the recycled refrigerant stream comprises at least one of: methane, ethylene, propane, or any combination thereof.

15. The liquefied natural gas system of claim 13, wherein the one or more refrigeration cycles are open refrigeration cycles.

16. The liquefied natural gas system of claim 13, wherein the nitrogen rejection unit further comprises a third condenser.

17. The liquefied natural gas system of claim 13, wherein the one or more refrigeration cycles are closed refrigeration cycles.

18. The liquefied natural gas system of claim 13, further comprising:

one or more reboilers, the one or more reboilers providing heating duty to one or more of the upstream nitrogen removal column or the downstream nitrogen removal column.

19. The liquefied natural gas system of claim 16, wherein the first condenser, the second condenser, and the third condenser are independently selected from the group consisting of: core-in-shell exchanger, brazed aluminum heat exchanger, shell and tube exchanger, kettle exchanger, printed circuit heat exchanger, and any combination thereof.

* * * * *